US005918653A

United States Patent [19]

Knerr

[11] Patent Number: 5,918,653

[45] Date of Patent: Jul. 6, 1999

[54] ADJUSTABLE SUPPORT FOR CONVEYOR

[75] Inventor: Michael P. Knerr, Ridgefield, Wash.

[73] Assignee: U. S. Natural Resources, Vancouver, Wash.

[21] Appl. No.: 09/098,920

[22] Filed: Jun. 17, 1998

[51] Int. Cl.[6] ..... B27B 31/00; B27B 1/00

[52] U.S. Cl. ..... 144/404; 144/246.1; 144/242.1; 144/248.4; 144/245.2; 144/250.25; 144/357; 144/408; 198/502.2; 198/782

[58] Field of Search ..... 144/3.1, 39, 41, 144/242.1, 246.1, 248.4, 245.2, 250.24, 250.25, 356, 357, 376, 377, 378, 382, 402, 404, 408, 416; 198/434, 624, 502.2, 782

[56] References Cited

U.S. PATENT DOCUMENTS

| | | | |
|---|---|---|---|
| 3,842,874 | 10/1974 | Noriyuki . | |
| 4,106,538 | 8/1978 | Sigfridsson et al. | 144/242.1 |
| 4,206,673 | 6/1980 | Detjen . | |
| 4,362,195 | 12/1982 | Hill | 144/242.1 |
| 4,518,061 | 5/1985 | Wehmeyer . | |
| 4,741,413 | 5/1988 | Kishi . | |
| 4,846,237 | 7/1989 | Wolf . | |
| 4,881,584 | 11/1989 | Wislocker . | |
| 5,070,989 | 12/1991 | Brown . | |
| 5,232,030 | 8/1993 | Knerr . | |
| 5,337,811 | 8/1994 | Fulghum, Jr. et al. | 144/242.1 X |
| 5,382,772 | 1/1995 | Zumstein . | |
| 5,385,186 | 1/1995 | Head . | |
| 5,421,385 | 6/1995 | McGee | 144/357 |
| 5,649,580 | 7/1997 | Mierau . | |
| 5,676,238 | 10/1997 | Saastamo . | |
| 5,853,038 | 12/1998 | Newnes | 144/357 |

*Primary Examiner*—W. Donald Bray
*Attorney, Agent, or Firm*—Robert L. Harrington

[57] ABSTRACT

An adjustable support for a conveyor has paired cylinders pivotally attached to the frame of the conveyor. The frame supports the mechanism for transporting a lumber product. Each pair of cylinders is mounted in a crossed configuration which provides rigid support for the frame. The controlled extension and retraction of the rods of the cylinders provides for elevating the frame, lowering the frame, side shifting of the frame as well as longitudinal tilt and lateral skewing of the frame.

6 Claims, 3 Drawing Sheets

ADJUSTABLE SUPPORT FOR CONVEYOR

This invention relates to an adjustable support, particularly for a conveyor, which enables the conveyor to be adjusted vertically and horizontally, and through a combination of adjustments as between a pair of supports, the conveyor can be adjusted for skew and taper.

BACKGROUND OF THE INVENTION

There is an ongoing need to develop lumber handling systems for reducing logs into lumber whereby the maximum percentage of the available wood is utilized for lumber production. Logs are irregularly shaped and vary greatly in dimension, and lumber is rectangular in cross section but has a wide range of cross section and lengthwise dimensions.

Consider that a log is tapered, curved and/or out of round. A scanner will establish the configuration and enter the data for computer evaluation. The computer determines the maximum boards of various dimensions that will fit that configuration and all of this scanning and evaluation is accomplished in seconds. Then it is up to the log handling and/or log break down apparatus to achieve the desired cutting pattern to produce the computed lumber pieces from that log.

There are numerous developments applicable to the adjustment of the break down apparatus. However, the present invention applies to the infeed system, e.g., a conveyor or conveyors from which the logs are fed into a log break down apparatus which may include, e.g., chippers and saws. The conveyor or conveyors are adjustable both vertically and laterally for adjusting the path of a log being fed into the chippers or saws.

BRIEF SUMMARY OF THE INVENTION

Typically each support of a pair of supports for a conveyor includes a combination of mechanical mechanisms, a mechanism used for raising and lowering the conveyor and a second mechanism for independently side shifting. The present invention achieves these movements through cooperative cylinder action.

The preferred embodiment of the present invention accomplishes the complexity of adjustments with two cylinders for each support. The two cylinders are anchored to a stationary base and extend angularly toward each other in a cross over arrangement. Each cylinder is connected to the base at one side of a support that is movable relative to the base and extends to and is connected to the support at the other side of the support. A second set of cylinders support the conveyor at the opposite end of the conveyor. The crossed cylinders produce desired and unexpected stability as well as maneuverability of the conveyor.

The cylinder rods are each independently and cooperatively extended from the cylinders to achieve the desired adjustment. It may be desirable to simply raise the entire conveyor. All four cylinder rods (at both end supports) are extended an equal amount and the entire conveyor is raised. A simple lowering is accomplished by simultaneous retraction of the cylinder rods. Side shifting is accomplished by extending the cylinders on one side and retracting the cylinders on the other side. Skew is accomplished by side shifting one end of the conveyor relative to the other. Tapered feeding is accomplished by controlled lowering or raising of the conveyor as the log is fed into the saws. Further, as may be needed, the conveyor can be tilted to rotatably adjust the log. Of course, any and all of these movements can be simultaneously achieved.

All of the above movements require precise relative adjustment of the cylinder rods and a computer control must be able to translate the required movement of the conveyor into cylinder rod extension/retraction for each of the cylinders.

The invention will be more fully understood with reference to the following detailed description and drawings referred to therein.

DESCRIPTION OF THE PREFERRED EMBODIMENT

Wood products, such as logs or cants hereafter collectively referred to as a log L, that are to be processed into lumber pieces are controllably oriented and positioned to assure maximum utilization of the log L.

Figure 1:
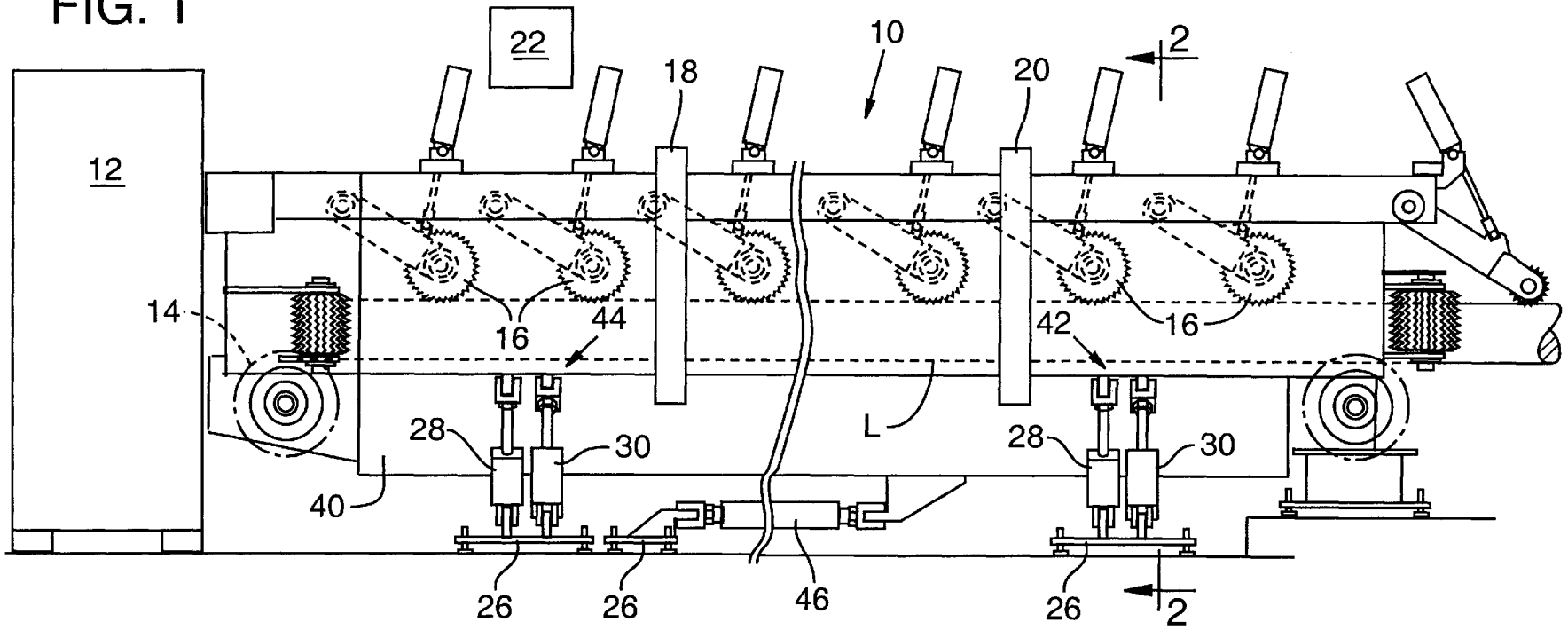
FIG. 1 is a side view of an infeed system incorporating the adjustable support of the present invention.

There are varied infeed systems that are utilized to convey an oriented log L into subsequent processing equipment. FIG. 1 illustrates by example one type of a conveyor system 10. The conveyor system 10 includes a log turner 12 that will rotate the log L into the desired rotative orientation such as in a horns down position. Log turners are well known in the industry and, therefore, are not detailed. In this embodiment, the conveyor system has a flighted chain 14 in combination with overhead rollers 16 to effectively hold and transport the oriented log L on the conveyor system 10. The rollers 16 are pivotally movable upwardly and downwardly toward the flighted chain 14 to accommodate different sizes of logs. The rollers 16 and the flighted chain 14 will hold the log L captive in its oriented position as it is being transported on the conveyor system 10. The log L as it is being transported by the conveyor system 10 is scanned by scanners 18 and 20. The scan data from the scanners 18 and 20 is input to a computer 22. The computer 22 will analyze the scan data and compute a desirable array of lumber pieces that can be generated from the log L. The computer further determines the need to adjust the log position relative to the processing equipment, e.g., saws and chippers, to obtain the desired breakdown of the log L.

The computer may determine, for example, that the log needs to be elevated or lowered relative to the processing equipment and/or the log may require shifting laterally to one side or the other. The adjustable support of the conveyor system of the present invention is arranged to accordingly adjust the position of the log L being conveyed on the conveyor system 10.

Figure 2:
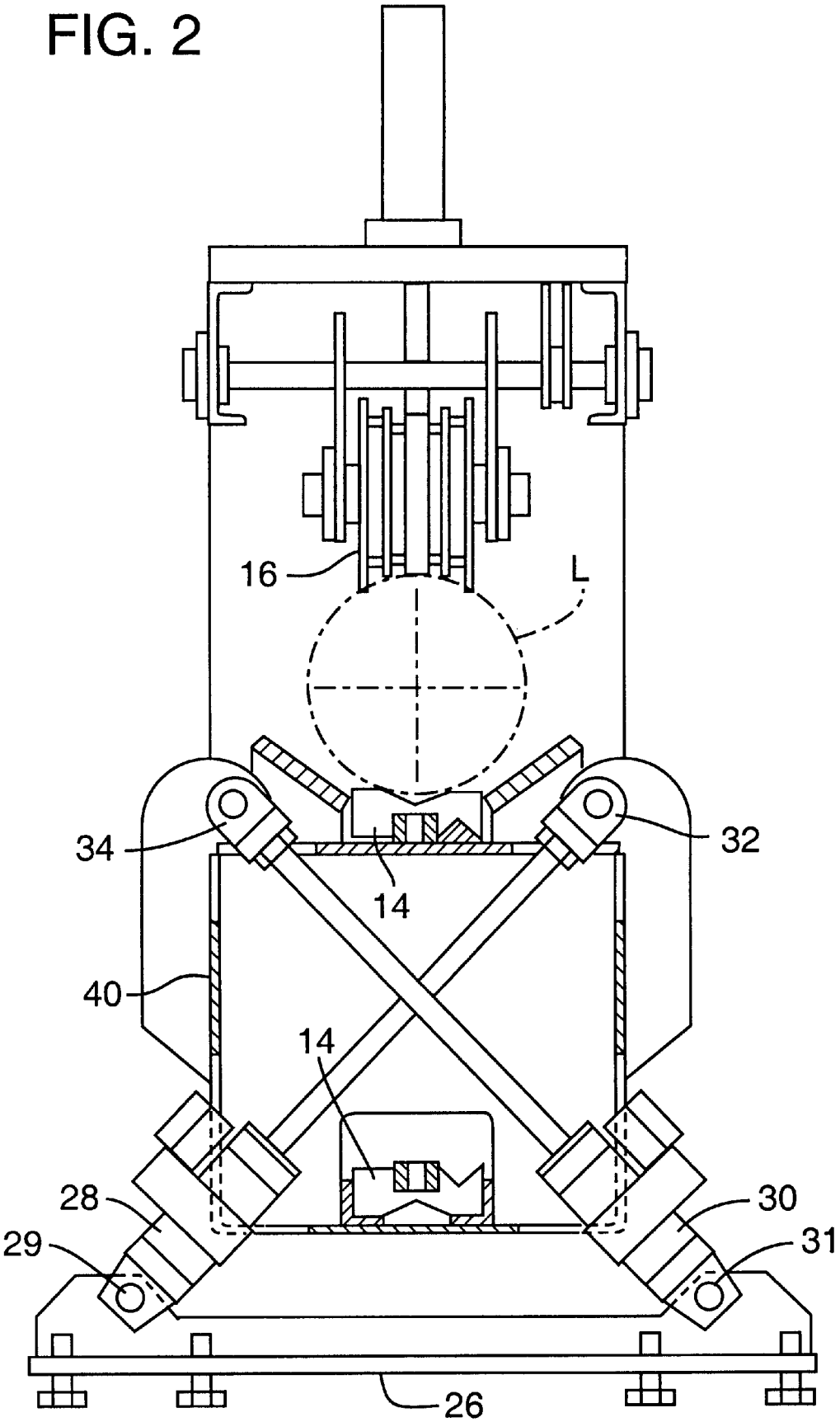
FIG. 2 is an end view of the infeed system as viewed on view lines 2—2 of FIG. 1; and, FIGS. 3A and 3B are views in diagram form showing examples of positional movement of the frame of the infeed system of FIG. 1.

FIGS. 1 and 2 illustrate the conveyor system 10 that incorporates the adjustable support of the present invention. Referring to FIG. 2, the conveyor system 10 has support bases 26 on which cylinders 28 are pivotally mounted by pivot pin 29 at the left side of base 26 (as viewed in FIG. 2) and cylinder 30 is pivotally mounted at the right side of pivot pin 31. The rod end 32 of cylinder 28 is pivotally mounted at the side opposite connecting pin 29 to the support frame 40 of the conveyor system 10. The rod end 34 of the cylinder 30 is pivotally mounted opposite its connecting pin 31 to the support frame 40. The cylinders 28, 30, as seen in FIG. 2, form an X pattern whereby the cylinder 28 crosses the cylinder 30.

A pair of cylinders 28, 30 (FIG. 1) are coupled to the frame 40 near one end designated as 42 and another pair of cylinders 28, 30 are coupled to the frame 40 near the opposite end designated as 44. The crossed pattern of the cylinders 28, 30 provides a rigid and stable support mechanism due to the triangulation effect. Tie rods 46 are coupled to one of the bases 26 and the frame 40 to prevent longitudinal movement of the frame 40.

The controlled extension and retraction of the cylinder rods of the cylinders 28, 30 provide for controlled positioning of the frame 40. The uniform extension of the cylinder rods of cylinders 28, 30 will elevate the frame 40. The uniform retraction of the cylinder rods of cylinders 28, 30 will lower the frame 40.

Figure 3A:
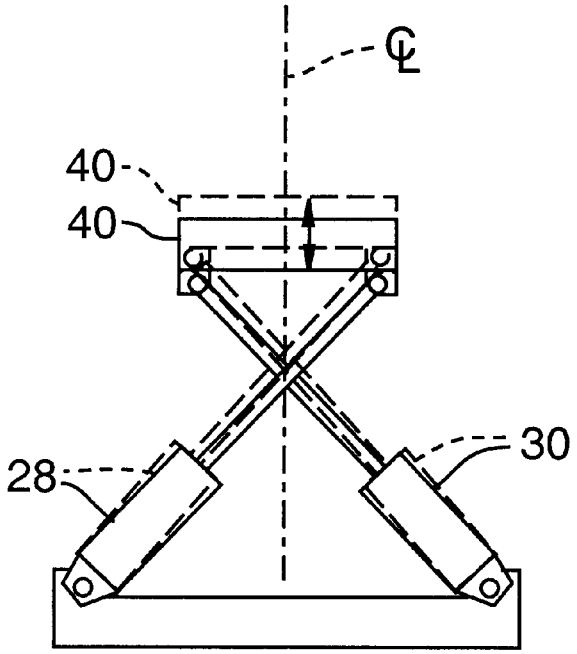

FIG. 3A illustrates the manner of elevating and lowering the frame 40 of the conveyor system 10 which will in effect elevate or lower a log L received on the flighted chain 14. The frame 40 is elevated by the uniform extension of the cylinder rods of the cylinders 28, 30. The frame 40 is shown in the elevated position in dashed line. As shown, the rods of the cylinders 28, 30 have been extended an equal distance. Similarly the frame 40 is lowered by the uniform retraction of the cylinder rods of the cylinders 28, 30. The frame 40 is shown in the lowered position in solid line. The cylinder rods of the cylinders 28 30 extend an equal distance. The equal extension of the cylinder rods of the cylinders 28, 30 will maintain the frame 40 on the reference center line of the conveyor 10.

Figure 3B:
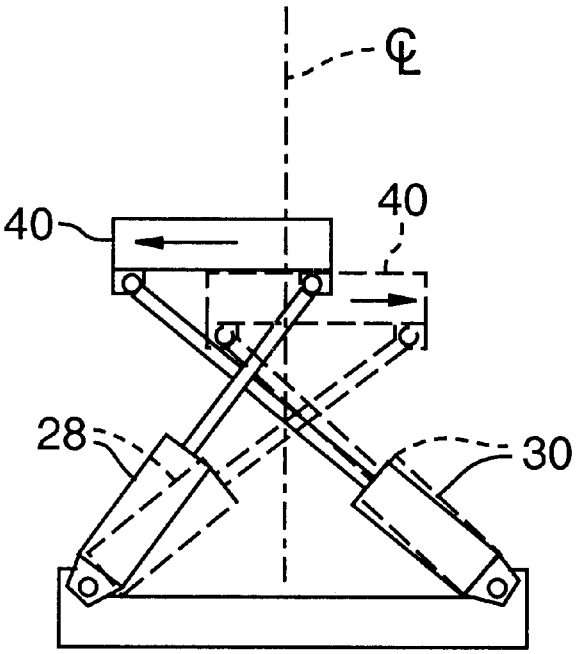

FIG. 3B illustrates the frame 40 that has been offset from the center line by extending the cylinder rod of the cylinder 30 a greater distance than the cylinder rod of the cylinder 28. The frame 40 shown in solid lines is offset to the left of the center line. Similarly the frame 40, as shown in dash lines, is offset to the right of the center line by extending the cylinder rod of the cylinder 28 a greater distance than the cylinder rod of the cylinder 30. It will be appreciated that the positions illustrated are given by example and that the frame 40 may be positioned at any location within the travel limits. The frame 40 is illustrated at different heights for illustration purposes and the computer will readily determine the required length of the cylinder rods for any positions of the frame 40 within the allowable range of movement of the rods.

One pair of cylinders 28, 30, e.g., at end 42, is operable separately from the other pair at end 44. This provides for varied positioning of the frame 40 and the log L received on the conveyor 10. The cylinders 28, 38 at end 42 may, for example, have their cylinder rods extended one distance and the cylinders 28, 30 at end 44 may have their rods extended a different distance. Referring again to FIG. 3A, the frame 40 at end 44 may be elevated to the position indicated by the dashed outline and the frame 40 at end 42 may be elevated to the position indicated by the solid outline. This provides a longitudinal tilt to the frame 40 to further control the positional adjustment of the log L on the conveyor 10.

Similarly the frame 40 may be offset at 42 as indicated by the dashed outline of FIG. 3B and offset at 44 as indicated by the solid outline. This will skew the frame 40 laterally as well as tilt the frame 40 longitudinally.

In the event that it is desirable for a log to be fed into the saws or chippers to accommodate a bottom or side taper, the orientation of the conveyor and thus the log may be continuously adjusted by the computer adjusting the cylinders as the log is fed into the processing equipment.

Those skilled in the art will recognize that modifications and variations may be made without departing from the true spirit and scope of the invention. For example, one variation would have a cylinder at each side of the conveyor support and a third horizontal cylinder at each support for stabilizing and side positioning as differentiated from the crossed cylinders described above. The invention is therefore not to be limited to the embodiments described and illustrated but is to be determined from the appended claims.

I claim:

1. An infeed conveyor for conveying a log or cant into a break down apparatus wherein the log or cant is converted at least in part to lumber, said infeed conveyor defining a direction of conveyance and comprising:

a pair of supports spaced apart along said direction and supporting opposed ends of the conveyor;

mechanism including at least a pair of extendable elongate members for each support, a base portion under each support and said extendable elongate members each having an end secured to the base portion at opposite sides of the support, and said extendable elongate members connected to opposite sides of the support, said mechanism arranged to provide both vertical and lateral movement of the supports; and a control for selectively controlling each extendable elongate member for cooperative movement of the elongate members to achieve selective up and down and side to side movement of each support for raising, lowering, skewing or tilting of a log as desired for achieving a desired cutting pattern of the log/cant.

2. An infeed conveyor as defined in claim 1 wherein the control provides continuous control of the log or cant for continuous adjustment of the conveyor and thus the log being fed into the break down system.

3. An infeed conveyor as defined in claim 1 wherein the extendable elongate members are cylinders having extendable rods, one end of each cylinder being connected to the base and the other end at the opposite side of the support whereby the two cylinders are in a cross over arrangement.

4. An infeed conveyor as defined in claim 3 wherein stability of the supports is enhanced by a tie rod extended between the base and the conveyor.

5. An infeed conveyor as defined in claim 1 wherein the elongate members are each mounted on one side of the conveyor for vertical movement, and a third elongate member providing stabilization and horizontal movement.

6. An infeed conveyor for conveying a log or cant into a break down apparatus wherein the log or cant is converted at least in part to lumber, said infeed conveyor defining a direction of conveyance and comprising:

a pair of supports spaced apart along said direction and supporting opposed ends of the conveyor;

a pair of extendable elongate members for each support, a base portion under each support and said extendable elongate members each having an end secured to the base portion at opposite sides of the support, and said extendable elongate members extended in a cross over arrangement and connected to the opposite side of the support; and a control for selectively controlling each extendable elongate member of each pair of members for cooperative movement of the elongate members to achieve selective up and down and side to side movement of each support for raising, lowering, shifting and skewing of a log as desired for achieving a desired cutting pattern of the log/cant.

* * * * *